US005573724A

United States Patent [19]

Soofi et al.

[11] Patent Number: 5,573,724

[45] Date of Patent: Nov. 12, 1996

[54] LADLE PORT ASSEMBLY

[75] Inventors: Madjid Soofi, St. Charles; George M. Connors, Chicago, both of Ill.

[73] Assignee: Magneco/Metrel, Inc., Addison, Ill.

[21] Appl. No.: 283,229

[22] Filed: Jul. 29, 1994

[51] Int. Cl.[6] ..... C21C 5/48

[52] U.S. Cl. ..... 266/265; 266/218; 266/224

[58] Field of Search ..... 266/218, 220, 266/224, 265, 266

[56] References Cited

U.S. PATENT DOCUMENTS

| | | | |
|---|---|---|---|
| 4,282,173 | 8/1981 | Ochiai et al. | 264/59 |
| 4,552,843 | 11/1985 | LaBate et al. | 266/200 |
| 4,588,170 | 5/1986 | Towns | 266/225 |
| 4,687,184 | 8/1987 | LaBate et al. | 266/270 |
| 4,744,544 | 5/1988 | LaBate et al. | 266/100 |
| 4,768,267 | 9/1988 | Burbach et al. | 266/220 |
| 4,783,058 | 11/1988 | Perri | 266/266 |
| 4,783,059 | 11/1988 | Perri | 266/266 |
| 4,836,433 | 6/1989 | Perri | 266/266 |
| 4,840,356 | 6/1989 | Labate | 266/265 |
| 4,898,369 | 2/1990 | Perri | 266/266 |
| 4,905,971 | 3/1990 | Rothfuss et al. | 266/266 |
| 4,938,461 | 7/1990 | Bertollo | 266/266 |
| 5,007,366 | 4/1991 | Handler | 116/208 |
| 5,065,986 | 11/1991 | Perri | 266/217 |
| 5,152,954 | 10/1992 | Helmut | 266/270 |
| 5,225,143 | 7/1993 | Labate, II et al. | 266/220 |
| 5,225,247 | 7/1993 | Dotsch et al. | 427/294 |

*Primary Examiner*—Melvyn Andrews
*Attorney, Agent, or Firm*—Brinks Hofer Gilson & Lione

[57] ABSTRACT

A ladle port assembly having a longer use life than a conventional porous plug includes an inner refractory member constructed from a high-fired alumina-containing refractory material, a middle refractory member surrounding the inner member and also constructed from a high-fired alumina-containing refractory material, a plurality of channel openings at an interface between the inner and middle refractory members, an outer refractory member surrounding the middle member, and a steel housing which contains the three refractory members. The high-firing of the inner and middle members increases their durability and hardness, reduces wear during use, and reduces the clogging of the channel openings which, in conventional porous plugs, has been caused by erosion and other forms of wear.

21 Claims, 4 Drawing Sheets

LADLE PORT ASSEMBLY

FIELD OF THE INVENTION

This invention relates to an improved porous plug assembly, and a method of making a porous plug assembly, for use in the gas entry ports of ladles used in the iron and steel industry.

BACKGROUND OF THE INVENTION

During the processing of molten steel in a ladle, an inert gas such as argon is typically bubbled into and through the molten steel. The bubbling of inert gas into the ladle facilitates uniform composition, uniform temperature control, oxygen removal, and purification of molten metal in the ladle. One conventional method of injecting the inert gas into the ladle involves the use of a port in the floor of the ladle. The space defining the port is occupied by a porous plug. Inert gas (typically argon) is continuously passed into the ladle through the porous plug, whereby the porous plug a) divides the inert gas into small bubbles and b) prevents molten metal from seeping into the gas inlet port, as long as the gas is being injected.

Conventional porous plugs have typically been constructed from a ceramic porous brick material surrounded by a steel shell, and held into place by a refractory mortar. The typical porous plug includes a large number of irregular interconnected passages resembling the openings in a sponge. Porous plugs having regular interconnected passages are also known.

Conventional porous plug structures are not very durable and tend to erode quickly, requiring frequent replacement. The tendency to erode, and become blocked, is due in part to the high temperatures in the ladle, which can reach 2700°–2900° F. Therefore, there is a need or desire in the iron and steel industry for porous plugs useful in ladle ports which accomplish all the objectives of conventional porous plugs, yet which are more durable and have much longer useful lives.

SUMMARY OF THE INVENTION

The present invention is a porous plug assembly for use in a ladle port which is much more durable, and has a much longer use life, than conventional porous plug assemblies. The invention also includes a method of making the improved porous plug of the invention.

The ladle port assembly of the invention includes three generally concentric refractory members and an outer steel shell. An inner refractory member having a solid, preferably cylindrical or semi-conical shape, is formed from a high alumina refractory material, for example, high alumina magnesia spinel. After setting, the inner member is fired at a temperature of at least about 2000° F. for a period of at least about 30 hours.

A middle refractory member having a hollow, preferably cylindrical or semi-conical shape, is formed around the inner member. The middle refractory member is also constructed from a high alumina refractory material, and can be constructed from the same material the inner member. After setting, the middle refractory member is fired at a temperature of at least about 2000° F. for a period of at least 30 hours, and can be fired simultaneously with the inner refractory member.

During the forming of either the inner refractory member, or the middle refractory member, or both, a plurality of channels are formed on an outer surface of the inner member, or on an inner surface of the middle member, or both. During operation of the ladle port assembly, the channels serve as openings at the interface between the inner refractory member and the middle refractory member, which opening are used for the introduction of inert gas to the ladle. Preferably, the openings are small in diameter and large in number, and do not interconnect with each other.

After the inner refractory member and middle refractory member have been formed, joined, and fired, they are placed, as a single insert, into a steel shell having a diameter larger than an outer diameter of the middle refractory member. Then, the space between the steel shell and the middle refractory member is filled with an outer layer of a refractory material which can be the same high alumina material used to construct the inner and middle members. The outer refractory member thus formed is permitted to set, and the entire resulting assembly (herein the "ladle port assembly" or "porous plug assembly") is baked at a temperature of at least about 500° F. for at least about two hours.

During operation, the high temperature-fired inner and middle refractory members provide exceptional durability and resistance to erosion, so that the gas inlet openings formed between the inner and middle members do not erode, change in size, or become plugged due to erosion, for a long period of time. The use of the high temperature-fired refractory members defining the openings thereby greatly prolongs the useful life of the ladle port assembly compared to the porous plugs of the prior art.

With the foregoing in mind, it is a feature and advantage of the invention to provide a porous plug assembly for use in ladles which is more durable, and has less tendency to erode during use, than conventional porous plugs.

It is also a feature and advantage of the invention to provide a porous plug assembly having a longer use life during exposure to ladle temperatures up to 2700°–2900° F., than conventional porous plugs.

It is also a feature and advantage of the invention to provide a method of making the durable porous plug assembly of the invention.

The foregoing and other features and advantages of the invention will become further apparent from the following detailed description of the presently preferred embodiments, read in conjunction with the accompanying drawings. The detailed description and drawings are considered to be illustrative rather than limiting, the scope of the invention being defined by the appended claims and equivalents thereof.

BRIEF DESCRIPTION OF THE DRAWINGS

FIG. 9(*a*) is a perspective view of an alternative embodiment of the mold of FIG. 9, used to form a ladle port assembly having a somewhat deeper inner refractory member.

DETAILED DESCRIPTION OF THE PRESENTLY PREFERRED EMBODIMENTS

Figure 2:
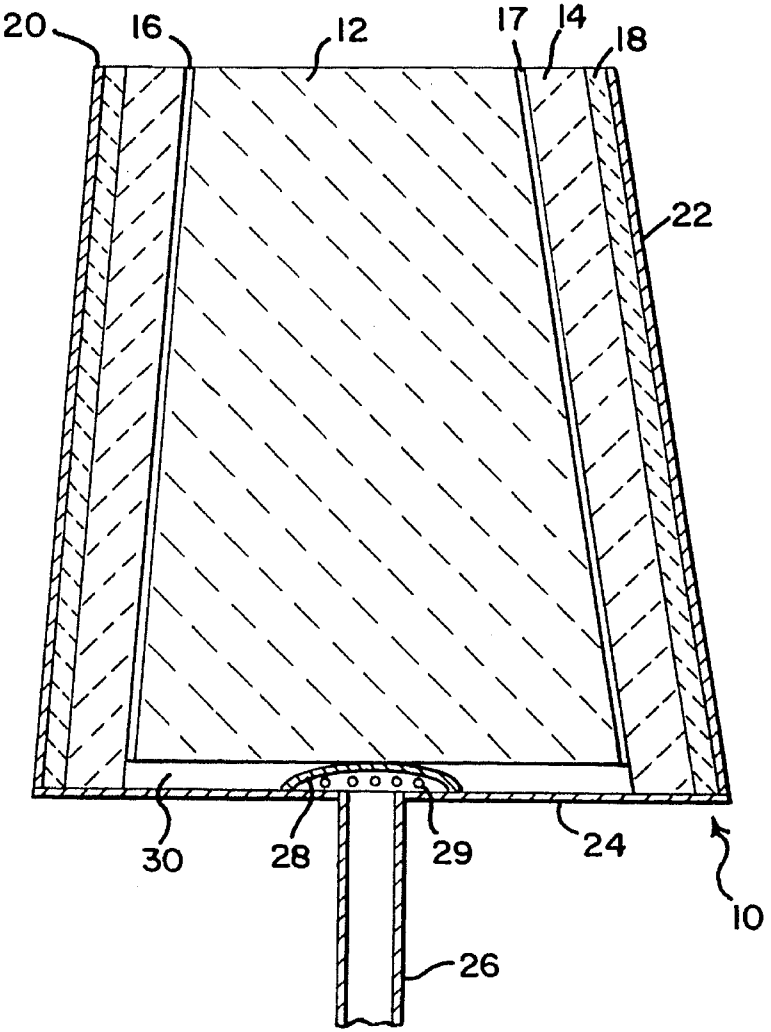
FIG. 2 is a sectional view taken along the line 2—2 in FIG. 1.
Figure 1:
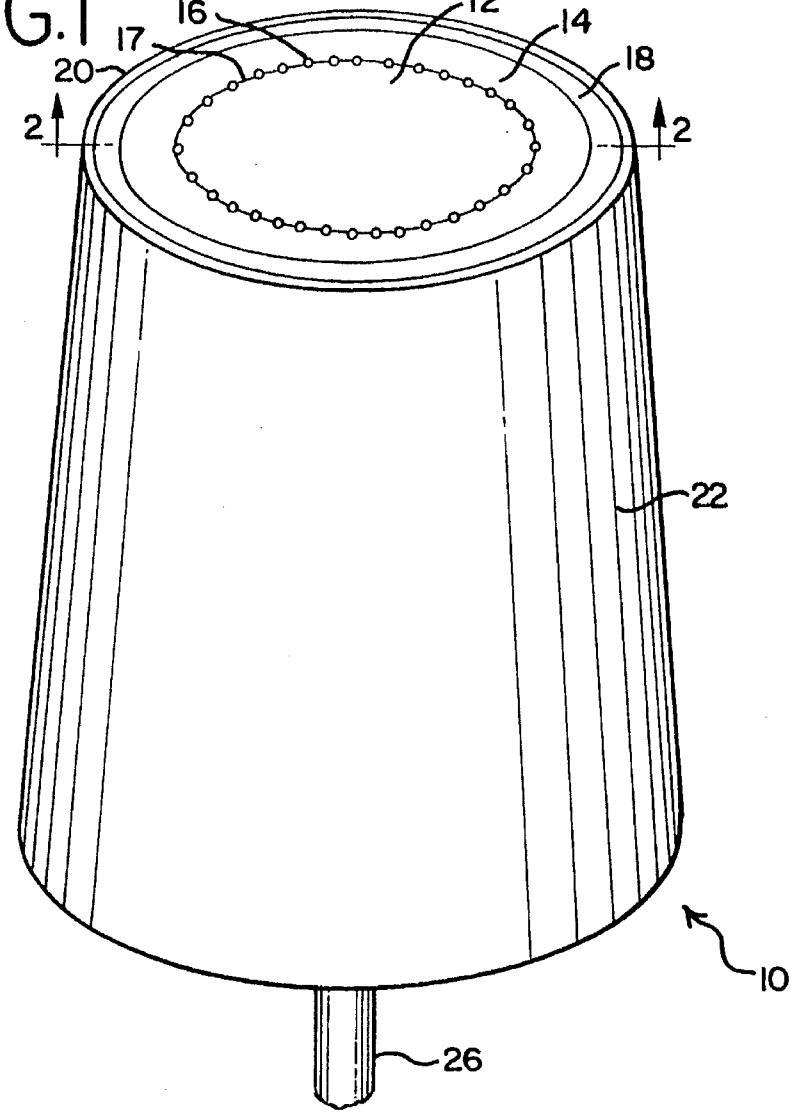
FIG. 1 is a perspective view of a ladle port assembly of the invention.

Referring to FIGS. 1 and 2, a ladle port assembly of the invention, generally designated as 10, includes an inner refractory member 12, a middle refractory member 14, a plurality of openings 16 at an interface 17 between the inner refractory member 12 and the middle refractory member 14, an outer refractory member 18, and a steel housing 20 containing the refractory members 12, 14 and 18.

The steel shell 20 includes a generally cylindrical or frusto-conical side wall 22, a floor 24 attached to the lower end of the side wall 22 (for examples, by welding), a gas feed inlet pipe 26 penetrating the floor 24 for receiving an inert gas such as argon from a source, and a dome 28 rising slightly above the floor 24 and surrounding the location where the feed pipe 26 meets the floor 24. The dome 28, which is also mounted to the floor 24, includes a plurality of small openings 29 for feeding inert gas received from the feed pipe 26 to an open space 30 located between the floor 24 and the bottom of the inner refractory member 12. The dome 28, and open space 30, may have heights of about 0.3–1.0 inch, for example.

As shown in FIG. 2, the middle refractory member 14 and the outer refractory member 18 extend substantially the entire length of the side wall 22 of the shell 20, and both terminate at the floor 24. The inner refractory member 12 terminates above the floor 24 and is designed to rest on the top of the dome 28, in order to permit the passage of inert gas through the open space 30. The three refractory members 12, 14 and 18 are generally cylindrical or frusto-conical and are concentric with each other, and with the wall 22. The inner refractory member 12 is adjacent to, and surrounded by, the middle refractory member 14 which, in turn, is adjacent to, and surrounded by, the outer refractory member 18. The outer refractory member 18 is, in turn, adjacent to, and surrounded by, the wall 22 of the steel shell 20.

The plurality of channel openings 16 are distributed evenly at the interface between the inner member 12 and the middle refractory member 14. The openings 16 are parallel and nonintersecting, extend the entire length of the inner member 12, and communicate with the open space 30. During operation, the channel openings 16 transmit inert gas between the refractory members 12 and 14, from the open space 30 to the interior of a ladle (FIG. 11) and release the inert gas to the molten metal in the form of small bubbles. The channels that define the openings 1 may be formed around the outer perimeter of the inner member 12, or around the inner perimeter of the middle member 14, or both, as explained further below.

Preferably, the openings 16 are small in diameter and large in number. The smaller the openings 16 are in diameter, the less likely they will become partially or totally plugged by molten metal from the ladle, so long as inert gas is fed through the openings continually. A larger number of openings 16 causes more small bubbles of inert gas to be transmitted to the ladle per unit of time, resulting in better mixing, temperature homogenization, deoxidation, and purification of the molten metal contained therein. Depending on the size of the ladle and of the ladle port assembly, the openings 16 should generally have diameters of about 0.01–0.15 inch, preferably about 0.02–0.10 inch, most preferably about 0.03–0.08 inch. Also, the number of evenly spaced channel openings 16 will generally range between about 10–50, preferably between about 15–40.

Figure 3:
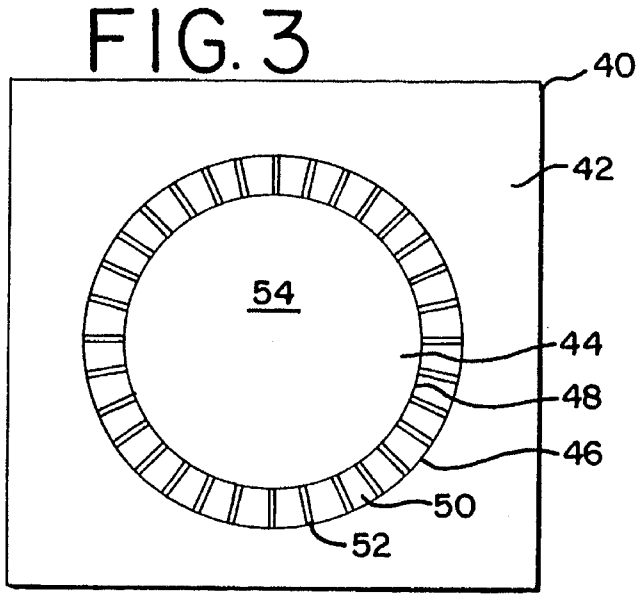
FIG. 3 is a top view of a mold used to form an inner refractory member of the ladle port assembly of the invention.

FIG. 3 illustrates one embodiment of a mold used to form an inner refractory member 12 wherein the channels ultimately defining the openings 16 are formed in the inner member 12. The mold 40 is preferably constructed from hard rubber or another bendable material in order to facilitate the release of the inner member 12 formed therein. The mold 40 includes a sleeve 42 which can be used to hang the mold from a template, and a cavity 44 corresponding to the shape of the member to be formed. The cavity 44 includes an upper lip 46, a lower lip 48, a wall 50 having a plurality of ridges or protrusions 52 extending the length of the wall 50, and a floor 54.

The upper lip 46 has a diameter larger than the diameter of the lower lip 48, thereby ensuring that the refractory member 12 (FIG. 5) Will have a frusto-conical shape. The protrusions or ridges 52 extending the length of the wall 50 cause the formation of the channels 16 in the member 12, which are ultimately used to transmit inert gas.

The mold 40 is filled with a high alumina refractory casting material which includes at least about 75% by weight alumina, preferably at least about 80% by weight alumina, most preferably at least about 85% by weight alumina. A highly preferred refractory material is high alumina magnesia spinel containing about 85–90% by weight alumina, about 5–10% by weight magnesia, and a minor quantity (i.e. less than about 5.0% by weight) of a conventional bonding agent such as calcium aluminate cement. Other conventional refractory materials can also be used, for example, refractories based primarily on magnesia or alumina.

The refractory material is poured into the mold 40 at room temperature, and is allowed to harden or set for about one hour. Then, the refractory member 12 is removed from the mold 40 by bending and peeling the surfaces of the cavity 44 until the member 12 falls or can be readily lifted. The inner member 12 can be fired (i.e. baked at high temperature) at this time, or the firing can be delayed until after the inner member 12 is combined with a middle refractory member 14. The firing of the inner member 12 involves placing the inner member in an oven and baking the inner member at a temperature of at least 2000° F., preferably at least 2500° F., most preferably about 2700°–2900° F. The firing time should be at least 30 hours, preferably at least 40 hours, most preferably at least about 48 hours.

Figure 4:
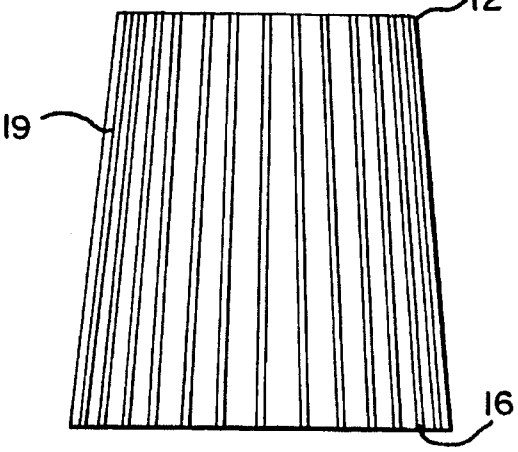
FIG. 4 is a front view of an inner refractory member used in the invention.

When the inner member 12 (FIG. 4) is ready to be combined with a middle member 14, the channels 16 are first filled with a temporary combustible or removable material 19. The temporary material 19 may be an organic glue, string, sawdust, or any combustible material. The material 19 may also be a removable material, for example, a steel wire coated with rubber or plastic. When glue or sawdust is used, for example, the filled channels 16 can be covered with a masking tape to temporarily secure the combustible material in place. The purpose of the temporary material, secured into place, is to prevent the channels 16 from being filled with refractory material during the subsequent forming of a middle refractory member 14 around the inner refractory member 12.

Figure 5:
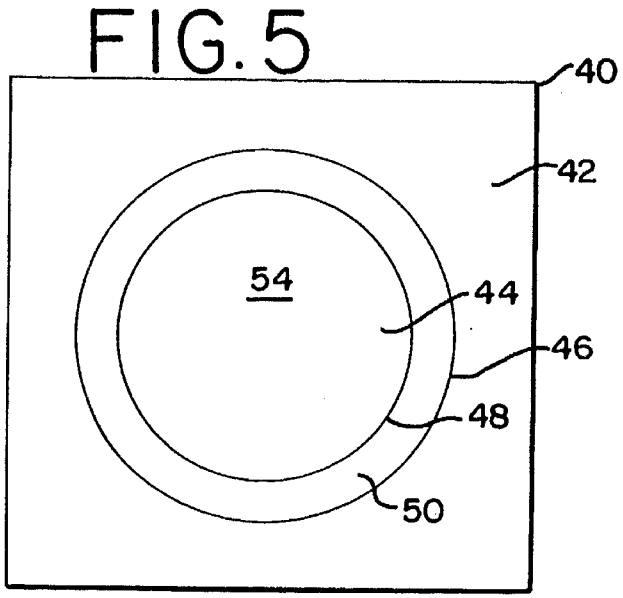
FIG. 5 is a top view of an alternative mold used to form an alternative inner refractory member used in the invention.
Figure 7:
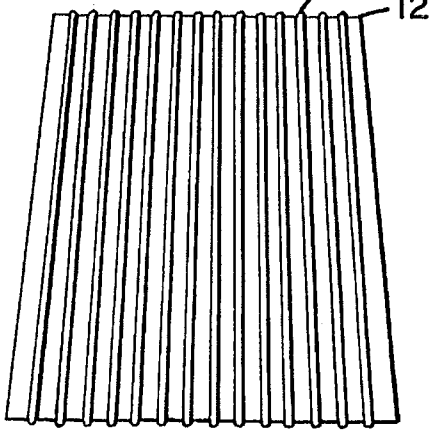
FIG. 7 is a front view of the inner refractory member of FIG. 5 which has been wrapped with string or another combustible or removable material to create a pattern corresponding to gas inlet channels to be formed.
Figure 6:
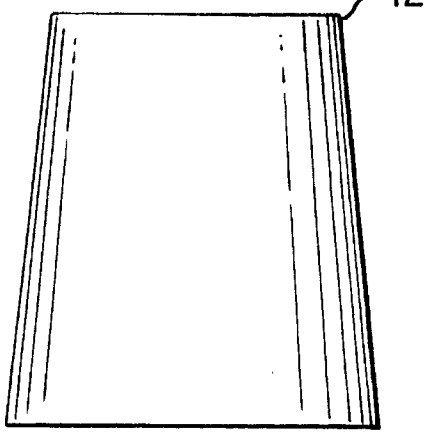
FIG. 6 is a front view of an alternative inner refractory member formed using the mold of FIG. 5.

FIG. 5 illustrates an alternative embodiment of the mold 40 which can be used to form an inner refractory member 12 having a smooth outer surface, for use when the channels defining the openings 16 are to be formed in the middle refractory member 14. The mold of FIG. 5 is similar to the mold of FIG. 3 except that the mold of FIG. 5 does not include ridges or protrusions 52 on the wall 50. The refractory member 12 thus formed is smooth, as shown in FIG. 6. In order to form the channels 16 during molding of the middle refractory member, the inner member 12 of FIG. 6 may be wrapped with strings 15, or combustible bands, or steel wires, or another temporary material as shown in FIG. 7. The strings or bands 15 create ridges on the outer surface of the inner member 12, which correspond to the channels ultimately formed in the middle member 14, during subsequent molding of the middle member 14 around the inner member 12.

Figure 9:
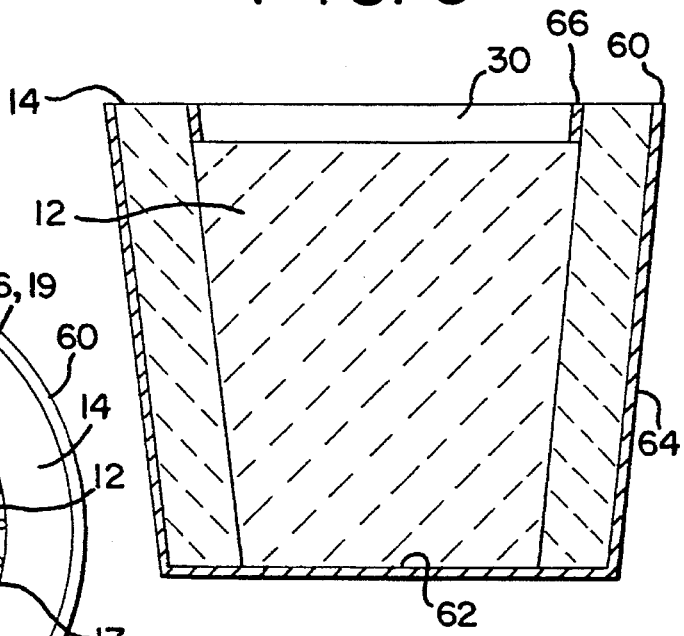
FIG. 9 is a sectional view of the mold of FIG. 8.
Figure 8:
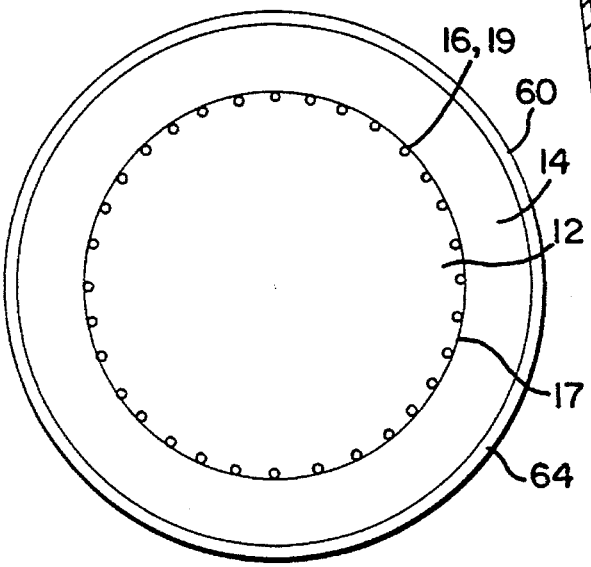
FIG. 8 is a top view of a mold used to form a middle refractory member around the inner refractory member.
Figure 9A:
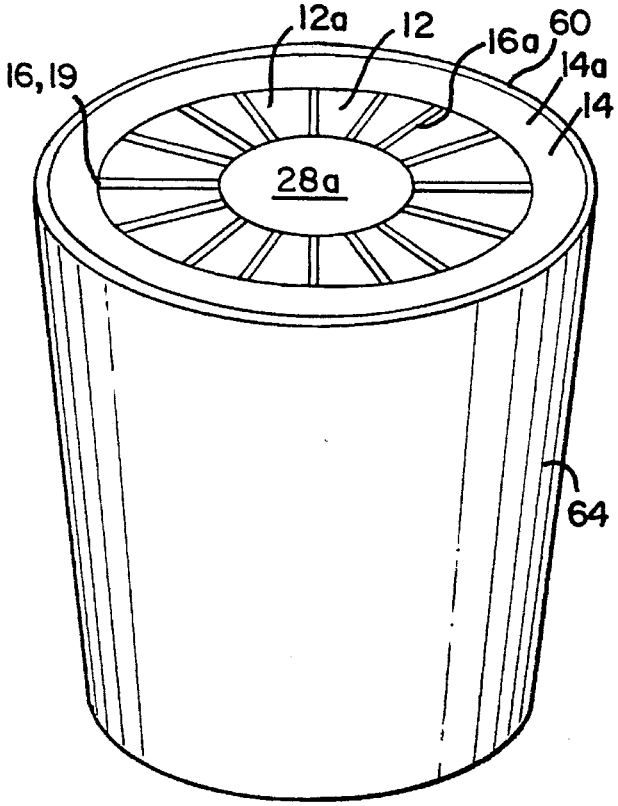
Figure 10:
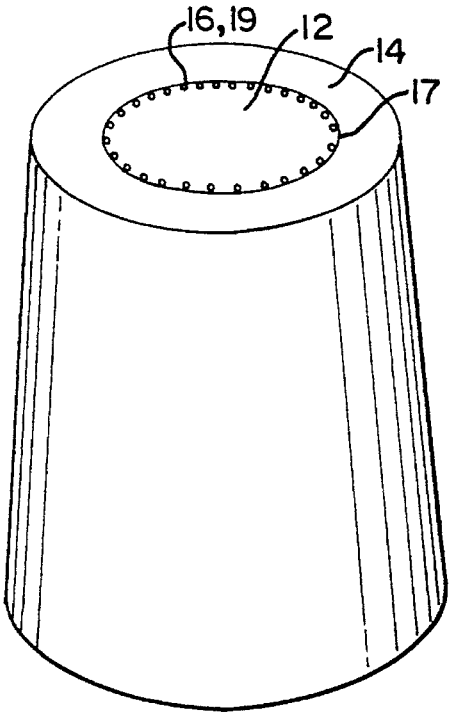
FIG. 10 is a perspective view of a middle refractory member formed and combined with an inner refractory member using the mold of FIGS. 8 and 9.

FIGS. 8–10 illustrate the formation of a middle refractory member 14 around the inner refractory member 12. As shown in FIG. 8, the inner member 12 is first placed and centered inside a larger mold 60 having a diameter about equal to the outer diameter of the middle member 14 to be formed. The mold 60, like the mold 40, is preferably constructed from hard rubber or another bendable, peelable material. The mold 60 has a floor 62 and a generally cylindrical or frusto-conical wall 64.

As shown in FIG. 9, the space between the mold 60 and the inner member 12 is then filled with a high alumina castable refractory material which preferably includes at least about 75% by weight alumina, more preferably at least about 80% by weight alumina, most preferably at least about 85% by weight alumina. The refractory material used to make the middle member 14 may be the same or different than that used to make the inner member 12. The presently preferred refractory material for the middle layer is the high alumina magnesia spinel described above. As stated above, other refractory materials, such as those based on magnesia or alumina, can also be used.

The space between the mold 60 and the inner member 12 is filled until the entire middle member 14 is formed. As shown in FIG. 9, a circular rim 66, having a depth of about 0.3–1.0 inch, may be temporarily placed at the wide end of the inner member 12 during formation of the middle member 14. The rim 66 permits the formation of that portion of the member 14 that ultimately extends below the dome 28 and open space 30 (See FIG. 2). Once formed, the middle member 14 is permitted to harden or set for about one hour. Then, the middle member 14 and inner member 12 are removed from the mold 60 by bending and peeling the mold 60 until the members 12 and 14 fall out or can be easily lifted. At this time, any noncombustible removable material (e.g. steel bands) occupying the channels 16, should be removed.

As an alternative to using a rim 66 as shown in FIG. 9 to maintain an opening space 30, the inner refractory member 12 may be initially formed in a different fashion as shown in FIG. 9(*a*). In FIG. 9(*a*), the inner member 12, as initially formed, is somewhat deeper so that the lower surface 12(*a*) of the inner member 12 corresponds to the lower surface 14(*a*) of the middle member 14, thereby eliminating the need for a rim 66. Also, the inner member 12 has a dome 28(*a*) formed directly into its lower surface, thereby eliminating the need for the steel support dome 28 shown in FIG. 2. In FIG. 9(*a*), the dome 28(*a*) is connected to the channels 16 via a plurality of channel extensions 16(*a*) formed in the lower surface 12(*a*) of the inner member 12. During use, inert gas entering the feed pipe 26 (FIG. 2) would pass through the dome 28(*a*) and channel extensions 16(*a*), and into the channels 16, if the alternative inner member 12 of FIG. 9(*a*) were used.

The alternative inner member 12 shown in FIG. 9(*a*) is formed in substantially the same manner described above with respect to FIGS. 3 and 4. After the refractory material is poured into a mold similar to the mold 40 in FIG. 3 (preferably, a slightly deeper mold), the dome 28(*a*) and channel extensions 16(*a*) are formed in the exposed surface 12(*a*) before the refractory material hardens. One way of providing these features is to press the surface 12(*a*) with a template having ridges corresponding to the channel extensions 16(*a*) and a center bulge corresponding to the dome 28(*a*). Other molding and forming methods can also be used.

Referring again to FIGS. 8–10, after being released from the mold 60, the refractory members 12 and 14 remain in combination as shown in FIG. 10. Next, the combined refractory members 12 and 14 are fired (i.e. baked in an oven) at a temperature of at least 2000° F., preferably at least 2500° F., most preferably about 2700°–2900° F. The firing time should be at least 30 hours, preferably at least 40 hours, most preferably at least about 48 hours.

The effect of firing the inner refractory member 12 and middle refractory member 14 is to cause the refractory members to become extremely hard and erosion-resistant. While the composition of the refractory members 12 and 14 remains generally unchanged during firing, their crystal structure is altered during firing to effect the hardening. Also, the firing causes any combustible material (e.g, the glue 19 in FIG. 4 or bands 15 in FIG. 7) to burn off, leaving behind the desired channel openings 16. Because both refractory members defining the channel openings are hardened during firing, the openings 16 are less likely to clog due to erosion during use, and the useful life of the resulting porous plug assembly is substantially prolonged.

The next step in manufacturing the ladle port assembly is to insert the combined refractory members 12 and 14 into a steel housing such as the steel shell 20 described above with respect to FIGS. 1 and 2. Referring to FIG. 2, the combined members 12 and 14 can be installed from the open top of the steel shell 20 if the largest outer diameter of the member 14 is smaller than the smallest inner diameter of the shell 20. Otherwise, the combined members 12 and 14 can be inserted from the bottom of the shell, and the steel floor plate 24 can be combined with the steel wall 22 after this insertion has been completed.

Once the insertion of the refractory members 12 and 14 into the steel shell 20 has been completed, the outer refractory member 18 can be formed by injecting a castable refractory material into the space between the middle member 14 and the steel wall 22 (FIG. 2). While the outer member 18 can be formed from any of a variety of suitable refractory casting materials, it is preferred that the refractory material be a high alumina type such as used for the inner refractory layer 12 and the middle refractory layer 14. Once the refractory material has been installed, the outer member 18 is allowed to harden or set for about one hour. Then, the entire porous plug assembly is heated to a temperature of at least 500° F., preferably about 800° F., for at least two hours.

Figure 11:
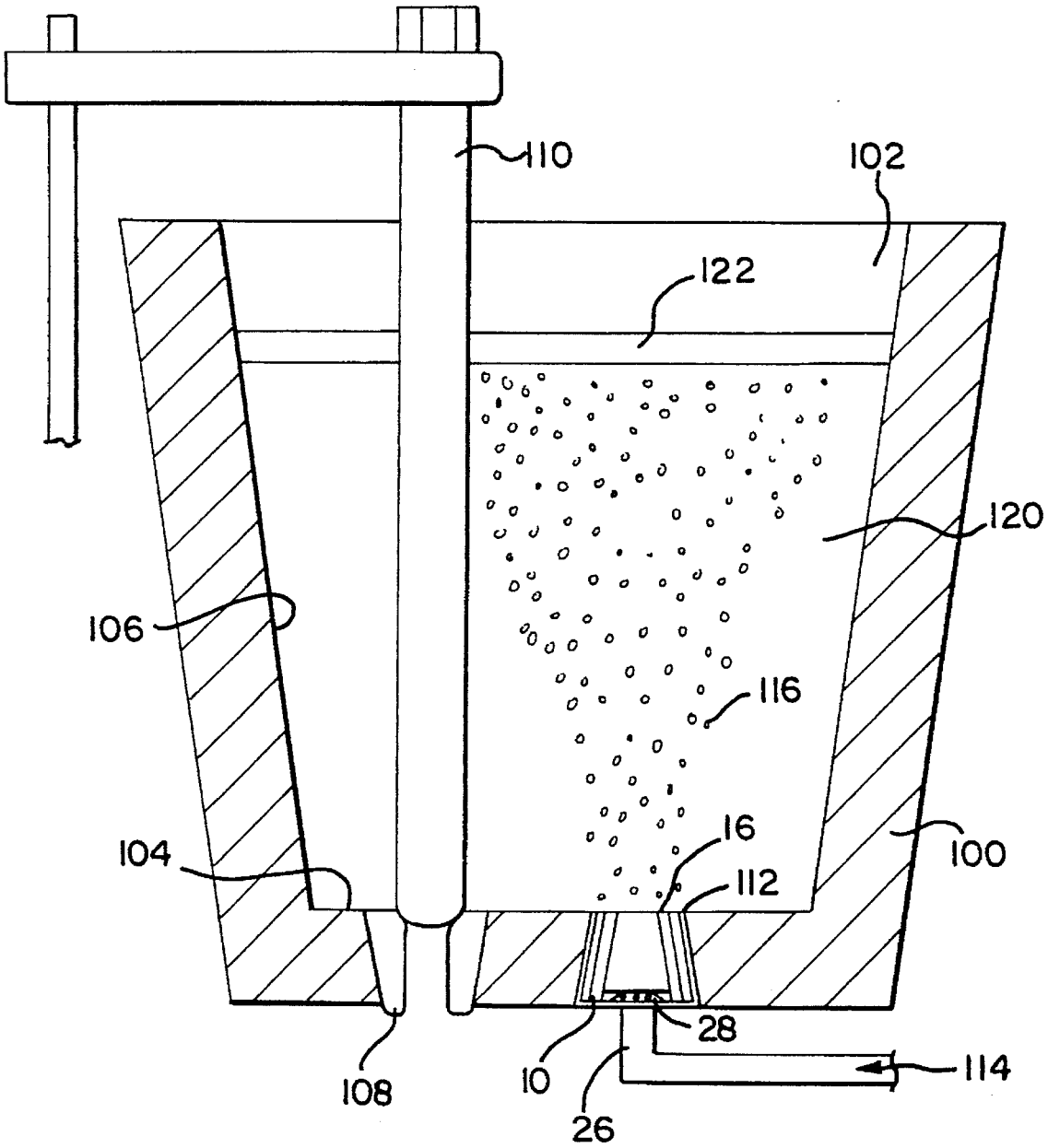
FIG. 11 is a sectional view of a ladle illustrating the operation of the ladle port assembly of the invention.

FIG. 11 illustrates the operation of the porous plug assembly 10 of the invention in a ladle port. A ladle 100 (shown in cross-section) includes an enclosure 102 defined by a floor 104 and a plurality of walls 106. A drain nozzle 108 is located in the floor 104, and flow of liquid metal through the drain is regulated by a retractable stopper assembly 110. The ladle floor 104 also includes an inert gas port 112, into which the ladle port assembly 10 is mounted and held into place with the assistance of a standard refractory mortar.

Inert gas enters the ladle port assembly from a source 114 connected to the gas feed inlet 26 on the ladle port assembly. The inert gas (preferably argon) passes through the dome region 28 and into the plurality of channels 16, whereupon the inert gas enters the molten metal 120 contained in the ladle, as small gas bubbles 116. As the inert gas bubbles 116 rise through the molten metal 120, they help homogenize the temperature and composition of the molten metal, and also cause oxygen and inclusions in the molten metal to rise toward the slag layer 122, thereby purifying the molten metal 120.

The ladle port assembly 10 of the invention should last up to 40–50 heats in a standard ladle having a capacity of 30–200 tons, with each heat lasting about one hour. The ladle port assembly 10 of the invention should outlast a conventional porous plug assembly by anywhere from 50–200% before replacement is required.

While the embodiments of the invention disclosed herein are presently considered to be preferred, various modifications and improvements can be made without departing from the spirit and scope of the invention. The scope of the invention is indicated in the appended claims, and all changes that fall within the meaning and range of equivalents are intended to be embraced therein.

We claim:

1. A ladle port assembly, comprising:

an inner refractory member including a fired high alumina refractory material of at least about 75% by weight alumina;

a middle refractory member adjacent to and surrounding the inner refractory member, the middle refractory member including a fired high alumina refractory material of at least about 75% by weight alumina;

an outer refractory member adjacent to and surrounding the middle refractory member; and a plurality of essentially straight nonintersecting openings at an interface between the inner refractory member and the middle refractory member defined by channels formed in at least one of the inner and middle refractory members and permitting the passage of gas between the inner refractory member and the middle refractory member;

wherein the inner and middle refractory members have been fired to a temperature of at least about 2000° F. to cause hardening.

2. The ladle port assembly of claim 1, further comprising a steel housing containing the inner, middle, and outer refractory members.

3. The ladle port assembly of claim 2, wherein the steel housing comprises at least one wall, a floor, a gas feed inlet penetrating the floor, and an open space between the floor and the inner refractory member permitting the passage of gas from the gas feed inlet to the channel openings.

4. The ladle port assembly of claim 1, wherein the firing temperature is at least about 2500° F.

5. The ladle port assembly of claim 1, wherein the firing temperature is about 2700°–2900° F.

6. The ladle port assembly of claim 1, wherein the channel openings number between about 10–50.

7. The ladle port assembly of claim 1, wherein the channel opening number between about 15–40.

8. The ladle port assembly of claim 1, wherein the channel openings have diameters of about 0.01–0.15 inch.

9. The ladle port assembly of claim 1, wherein the channel openings have diameters of about 0.02–0.10 inch.

10. The ladle port assembly of claim 1, wherein the channel openings have diameters of about 0.03–0.08 inch.

11. The ladle port assembly of claim 1, wherein the channel openings are about evenly spaced apart.

12. The ladle port assembly of claim 1, wherein the fired high alumina refractory materials of the inner and middle members comprise a high alumina-magnesia spinel.

13. The ladle port assembly of claim 3, wherein the steel housing further comprises a dome mounted on the floor, the dome having opening permitting the passage of gas.

14. A ladle port assembly, comprising:

an inner refractory member formed with an alumina-containing refractory material and fired to a temperature of at least about 2000° F. for a time sufficient to cause hardening;

a middle refractory member formed with an alumina-containing refractory material and fired to a temperature of a least about 2000° F. for a time sufficient to cause hardening, positioned adjacent to and surrounding the inner refractory member;

an outer refractory member adjacent to and surrounding the middle refractory member;

a plurality of essentially straight nonintersecting openings at an interface between the inner refractory member and the middle refractory member defined by channels formed in at least one of the inner and middle refractory members and permitting the passage of gas between the inner refractory member and the middle refractory member; and a steel housing containing the inner, middle and outer refractory members.

15. The ladle port assembly of claim 14, wherein the inner refractory member is substantially cylindrical.

16. The ladle port assembly of claim 14, wherein the inner refractory member is frusto-conical.

17. The ladle port assembly of claim 14, wherein the middle refractory member is substantially cylindrical.

18. The ladle port assembly of claim 14, wherein the middle refractory member is frusto-conical.

19. The ladle port assembly of claim 14, wherein the inner, middle and outer refractory members are concentric.

20. The ladle port assembly of claim 14, wherein the inner and middle refractory members are fired to a temperature of at least about 2500° F.

21. The ladle port assembly of claim 14, wherein the inner and middle refractory members are fired to a temperature of at least about 2700° F.

* * * * *

UNITED STATES PATENT AND TRADEMARK OFFICE

CERTIFICATE OF CORRECTION

PATENT NO. : 5,573,724

DATED : November 12, 1996

INVENTOR(S) : Madjid Soofi et al.

It is certified that error appears in the above-identified patent and that said Letters Patent is hereby corrected as shown below:

In Claim 7, line 2, replace "opening" with --openings--.

Signed and Sealed this

Twenty-eighth Day of July, 1998

*Attest:*

Bruce Lehman

BRUCE LEHMAN

*Attesting Officer*

*Commissioner of Patents and Trademarks*